US006761405B2

(12) United States Patent
Bellefleur

(10) Patent No.: US 6,761,405 B2
(45) Date of Patent: Jul. 13, 2004

(54) LOCKING ASSEMBLY FOR A ROCKING CHAIR

(75) Inventor: Pierre Bellefleur, Magog (CA)

(73) Assignee: Dutailier International Inc., Quebec (CA)

( * ) Notice: Subject to any disclaimer, the term of this patent is extended or adjusted under 35 U.S.C. 154(b) by 0 days.

(21) Appl. No.: 10/431,970

(22) Filed: May 8, 2003

(65) Prior Publication Data

US 2003/0197406 A1 Oct. 23, 2003

Related U.S. Application Data

(60) Division of application No. 09/927,821, filed on Aug. 10, 2001, which is a continuation-in-part of application No. 09/518,886, filed on Mar. 6, 2000, now Pat. No. 6,402,242.

(30) Foreign Application Priority Data

Jan. 13, 2000 (CA) ..... 2296032

(51) Int. Cl.[7] ..... A47C 31/00; A47C 3/02

(52) U.S. Cl. ..... 297/270.1; 297/270.2; 297/281; 297/270.3

(58) Field of Search ..... 297/270.1, 270.2, 297/270.3, 270.4, 281

(56) References Cited

U.S. PATENT DOCUMENTS 4,469,301 A 9/1984 Chevalier
4,591,207 A 5/1986 Nithammer et al.
4,738,156 A 4/1988 Pipon et al.
6,120,094 A * 9/2000 Parent ..... 297/270.1
6,213,551 B1 4/2001 Desnoyers et al.
6,244,658 B1 * 6/2001 Parent et al. ..... 297/270.1
6,406,095 B1 * 6/2002 Bouchard et al. ..... 297/281 X

* cited by examiner

*Primary Examiner*—Anthony D Barfield
(74) *Attorney, Agent, or Firm*—Ladas & Parry

(57) ABSTRACT

A rocking chair including a body supporting portion, a chair base portion, a locking assembly arid a linkage. The linkage includes a strip of resilient material extending across the backrest of the chair, positioned to receive the back of an occupant of the chair. The strip has a resiliency such that, when an occupant leans back against the backrest of the chair, the strip is responsive to the pressure applied directly thereto to deform rearwardly from an original position and, when the pressure ceases, the strip returns to its original position. The linkage is operatively connected to the locking assembly to cause the locking assembly to prevent movement of the body supporting portion relative to the chair base portion when the strip is in the original position, and to cause the locking assembly to allow movement of the body supporting portion relative to the chair base portion when the strip is deformed rearwardly from the original position.

22 Claims, 10 Drawing Sheets

LOCKING ASSEMBLY FOR A ROCKING CHAIR

CROSS-REFERENCES TO RELATED APPLICATION

This application is a divisional application of U.S. patent application Ser. No. 09/927,821, filed Aug. 10, 2001, which is a continuation-in-part of U.S. patent application Ser. No. 09/518,886, filed Mar. 6, 2000, now U.S. Pat. No. 6,402,242.

FIELD OF THE INVENTION

The present invention relates to the art of manufacturing chairs and, more particularly, to a novel locking assembly for rocking chairs. The locking assembly is characterized by its ability to lock the body portion of the chair relative to the base portion of the chair in a selected position.

BACKGROUND OF THE INVENTION

A typical rocking chair includes a body supporting structure that is mounted on a chair base by a rocking assembly. The prior art has recognised that it is desirable to provide rocking chairs with a locking mechanism that allows retaining the body-supporting portion of the chair in a certain position with relation to the base. This is useful in instances where the occupant of the chair wishes to negate at least temporarily the rocking function of the chair.

One locking mechanism that is known in the art comprises two components, namely a rack element including a plurality of fingers in a spaced apart relationship, and a pin element that can fit between selected fingers of the rack. The rack element is mounted to the body-supporting portion of the chair while the pin is mounted to the chair base portion. The rack element is also provided with a linkage that allows moving the rack in and out of engagement with the pin. In use, when the occupant of the chair desires to lock the chair in a certain position, he or she operates the linkage to bring the rack in engagement with the pin such that the pin enters the fingers that correspond to the selected position in which the chair is to be immobilized. To release the lock, it suffices to operate the linkage in the opposite direction and thus disengage the rack from the pin.

This type of locking mechanism is not entirely satisfactory for a number of reasons. One of its drawbacks relates to the smoothness of operation. For instance, the rack will engage with the pin only when the inter-pin space is precisely aligned with the pin. In a situation when the occupant of the chair attempts to engage the locking mechanism in a position such that a finger of the rack interferes with the pin, engagement will not be possible until the occupant of the chair slightly shifts the position of the body-supporting portion of the chair such that the pin enters between two fingers of the rack.

Another drawback is the requirement of providing a long rack when a wide range of locking positions on the chair are desirable, which may not be aesthetically advantageous.

Against this background, it clearly appears that there is a need in the industry to provide a locking assembly for rocking chairs that avoids or at least alleviates drawbacks associated with prior art locking assemblies.

SUMMARY OF THE INVENTION

In one aspect the present invention provides a locking assembly for a rocking chair, the rocking chair having a body-supporting portion mounted for rocking movement on a chair base portion. The locking assembly comprises a first locking assembly component for mounting to the body-supporting portion and a second locking assembly component for mounting to the chair base portion. The first and the second locking assembly components can be interlocked to retain the body-supporting portion at a selected position relative to the chair base portion.

The first locking assembly component includes a pair of jaws capable to acquire two operative conditions. The second locking assembly component includes at least one pin. In the first operative condition, the jaws wedge the pin between them and thus retain the body-supporting portion of the chair relative to the base portion of the chair in a certain position, preventing the body-supporting portion of the chair from rocking. In the second operative position, the jaws release the pin, allowing the pin to move relative to the jaws such as to allow the chair to rock.

An advantage of the locking mechanism over prior art designs is its smoothness of operation. As the first locking assembly component is operated to cause the pin to become wedged between the jaws, the jaws and consequently the body-supporting portion of the chair, are guided toward the locking position when the jaws engage the pin. There is no necessity for the occupant of the chair to gage and adjust the position of the body-supporting portion of the chair relative to the chair base portion such as to allow the two components of the locking assembly to interengage. Another advantage of this locking assembly is its low profile. To extend the range of locking positions, it suffices to add more pins to the chair base, where each pin corresponds to a different locking position. Since the pins are relatively small, the locking mechanism remains discreet.

One possible variant of the structure described above is to reverse the position of the locking assembly components, and mount the first locking assembly component to the chair base portion while mounting the second locking assembly component to the body-supporting portion of the chair.

In a specific non-limiting example of implementation, the first locking assembly component includes a pair of jaws that move with relation to one another when a linkage is operated. Typically, the linkage includes a handle that extends on the side of the chair and that can be operated by the user to open or to close the jaws. The relationship between the jaws is such that when a movement is imparted to one jaw by the linkage, the other jaw is also caused to move. When the linkage is operated to engage the locking assembly, the jaws move with relation to one another such as to grip the pin. In particular, the gripping faces of the jaws undergo motions in two directions. First, the gripping faces move away from one another such as to define a receptacle for receiving the pin. Second, the gripping faces move down to come and bear on the pin, thus immobilizing it. The arrangement between the various parts forming the gripping assembly is such that during the initial phase of the locking assembly engagement, the gripping faces of the jaws move faster away from one another than toward the pin. This arrangements allows to first form the pin catching receptacle and then to cause the receptacle to fit on the pin such as to wedge the pin. When the locking assembly is released, the opposite sequence of motions occurs.

The present invention also extends to a rocking chair including the locking assembly described above.

In another broad aspect, the invention provides a chair with a body-supporting portion that moves relative to a chair base portion. The body-supporting portion has a backrest and a seat. A locking assembly is provided to prevent the movement of the body-supporting portion relative to the chair base portion. The chair has a linkage to operate the locking assembly. The linkage includes a resilient strip mounted on the backrest. When an occupant applies pressure on the backrest the strip is deformed rearwardly. When the pressure ceases, the strip returns to its original position. The linkage is coupled to the locking assembly to cause the locking assembly to operate and prevent the movement of the body-supporting portion when the strip is in its original position. Conversely, when the strip is deformed rearwardly, the locking assembly is disengaged.

BRIEF DESCRIPTION OF THE DRAWINGS

In FIG. 1, only the structure of the chair is shown, the upholstery being removed for purposes of clarity;

DETAILED DESCRIPTION

Figure 1:
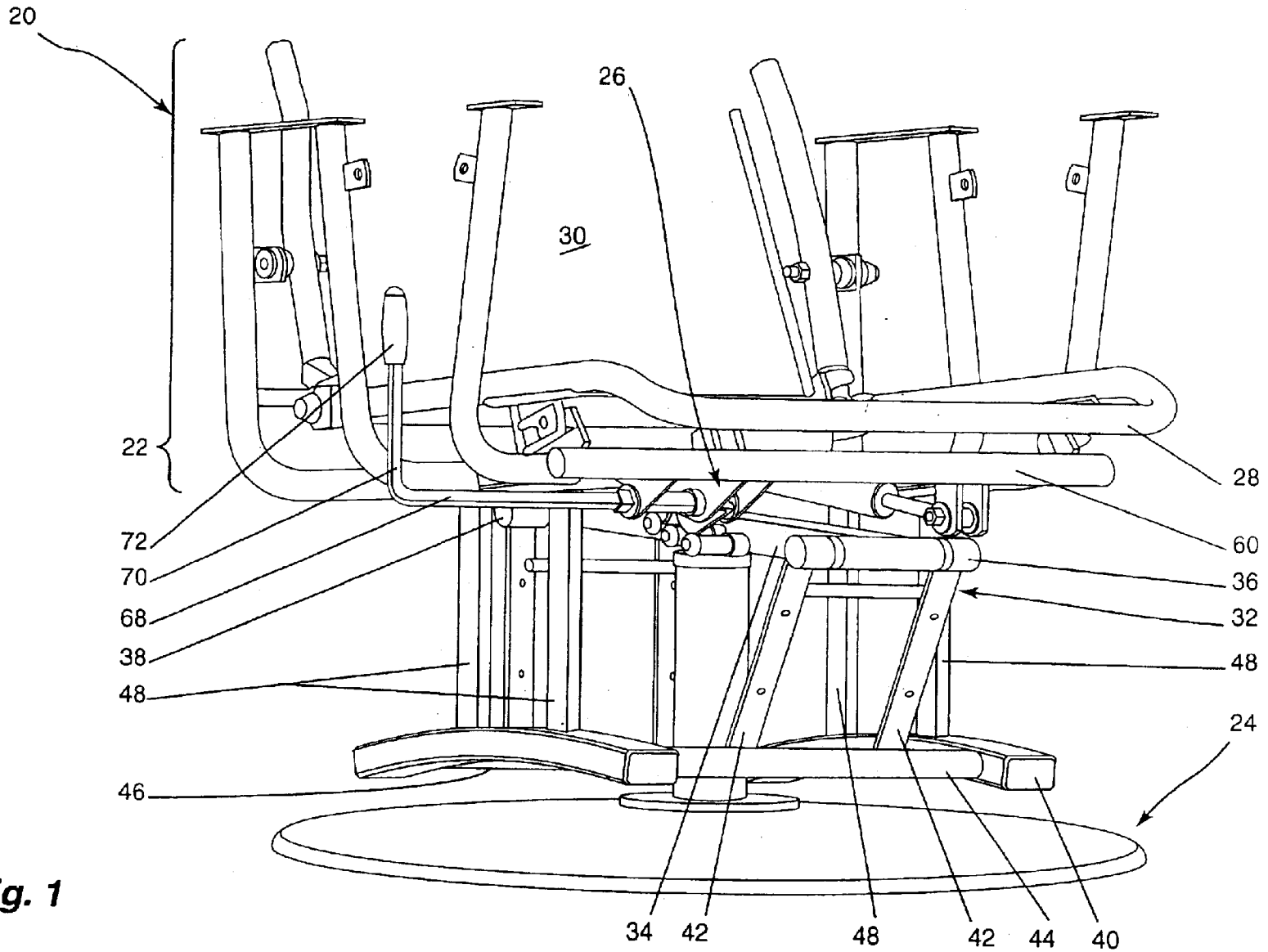
FIG. 1 is a perspective view of a rocking chair incorporating the locking assembly constructed according to the principles of the present invention.

FIG. 1 of the drawings illustrates a chair designated by the reference numeral 20 that embodies the principles of the present invention. The chair 20 can be broken down into three main components namely a body-supporting portion 22, a chair base portion 24 and a locking assembly 26 that allows the body supporting portion 22 to be interlocked with the chair base 24 at a selected position.

The body-supporting portion 22 comprises two main components namely a seat portion 28 and a backrest 30. The chair base portion 24 comprises a circular member of sufficient size to adequately support the chair 20 on the floor, although this is only a question of design since a wide variety of chair base portions can be used here without departing from the spirit of the invention.

The body-supporting portion 22 is connected with the chair base portion 24 through the intermediary of a rocking mechanism 32 that allows the chair 20 to rock back and forth. The specific type of rocking mechanism is not critical for the success of this. As an example a rocking mechanism can be used that includes a horizontal bar 34 carrying at each end two hinges 36 and 38 that pivot about horizontal and parallel axes. A sub-frame 40, mounted below the seat portion 28 is connected to the hinges 36, 38, through links 42, themselves pivotally mounted to the sub-frame 40 at 44, 46, about horizontal axes that are parallel to the horizontal axes of the hinges 36, 38.

The body-supporting portion 22 is mounted to the rocking mechanism 32 by generally vertical bars 48 extending between the seat portion 28 and the sub-frame 40. This arrangement allows the body-supporting portion 22 to rock back and forth relative to the chair base portion 24.

The locking assembly 26 is provided to lock the body-supporting portion 22 at a selected position with respect to the chair base 24. In a specific example of implementation, the locking assembly 26 provides a plurality of positions in which the body-supporting portion 22 can be locked relative to the chair base portion 24.

The structure of the locking assembly 26 is illustrated in greater detail in FIGS. 3 to 10. The locking assembly 26 includes two components, namely a first locking assembly component 50 mounted to the body-supporting portion 22 and a second locking assembly component 52 mounted to the chair base portion 24. The first locking assembly component 50 comprises a pair of jaws that are operated by a linkage. The second locking assembly component 52 includes a plurality of pins, each pin corresponding to a different locking position of the body-supporting portion 22 with relation to the chair base portion 24. The locking assembly is in a locked condition when the jaws of the first locking assembly component 50 grip a pin of the second locking assembly component 52.

Figure 3:
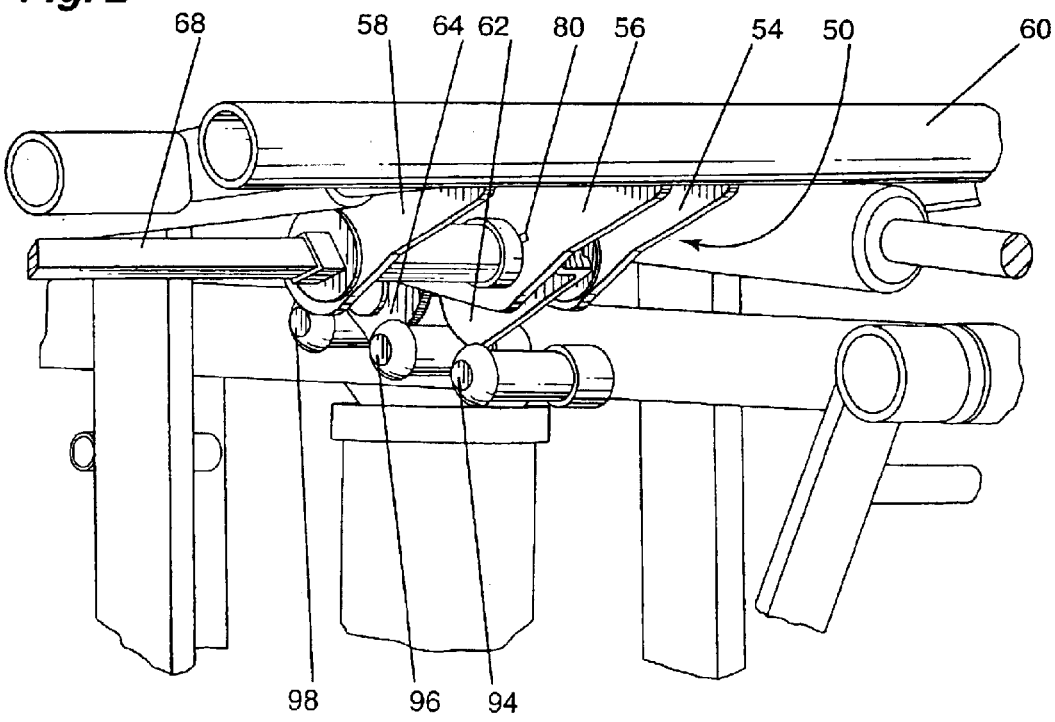
FIG. 3 is a further enlarged perspective view of the locking assembly depicted in FIG. 1, the locking assembly being engaged to prevent the chair from rocking.
Figure 4:
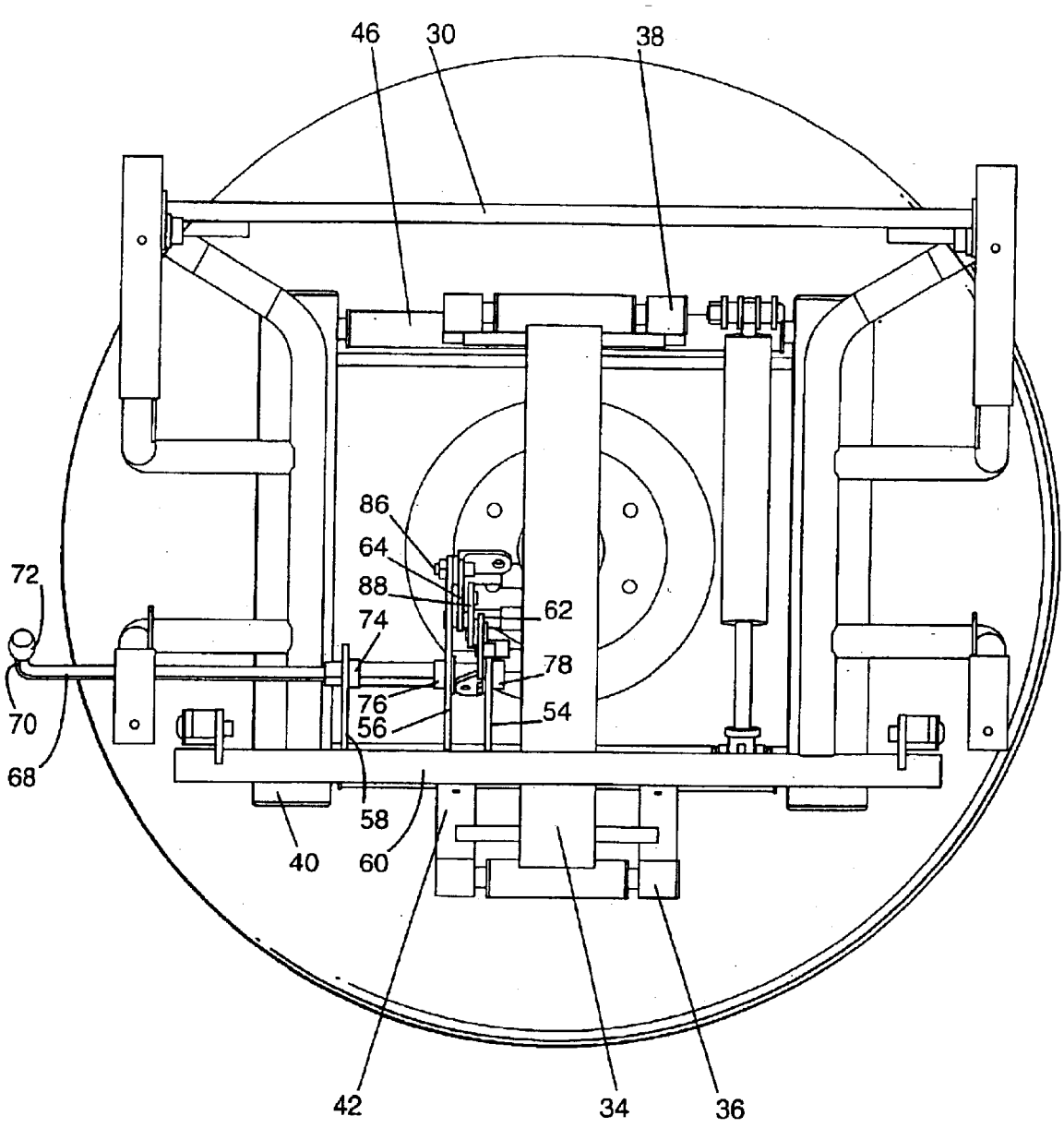
FIG. 4 is a top plan view of the chair depicted in FIG. 1.

With reference to FIG. 3, the first locking assembly component 50 comprises three generally parallel flat plates 54, 56 and 58 that are welded to a horizontal bar 60 forming part of the seat 28. The purpose of the three plates 54, 56 and 58 is to provide a structure allowing to pivotally support the various elements of the first locking assembly component 50. A pair of jaws 62 and 64 are mounted to the plates 54, 56.

Figure 9:
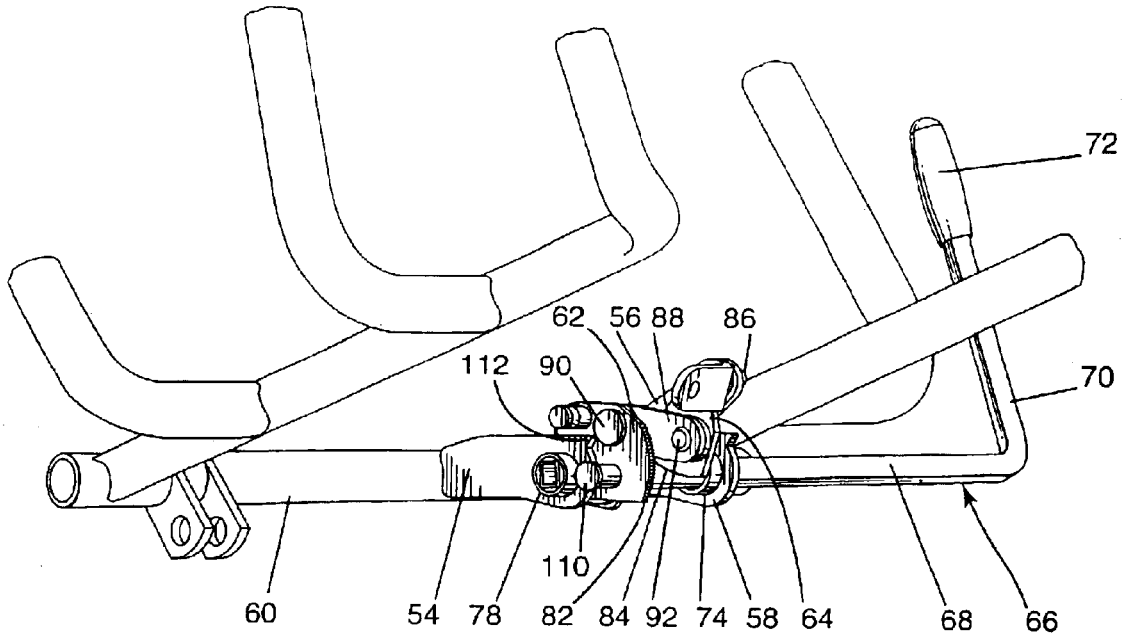
FIG. 9 is yet another perspective view from a different angle of the locking assembly in accordance with the invention, some components of the chair being also illustrated to provide a frame of reference.
Figure 10:
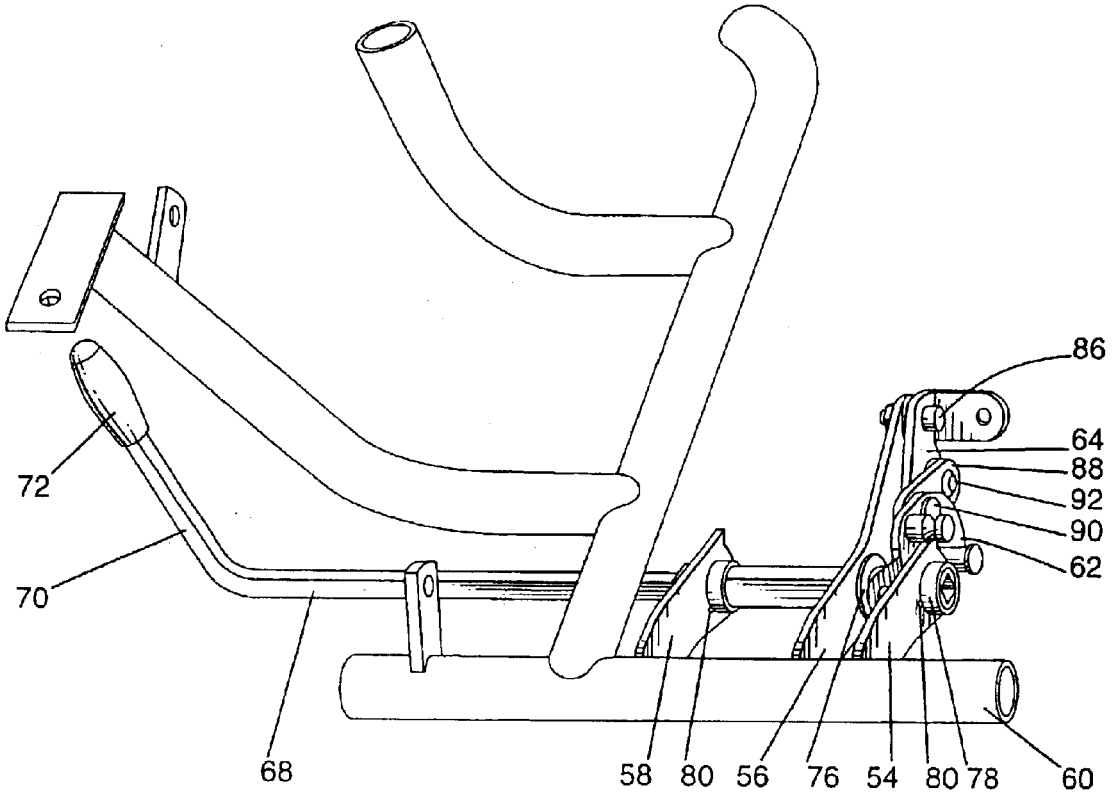
FIG. 10 is yet another different perspective view from the locking assembly in accordance with the invention, some components of the chair being also illustrated to provide a frame of reference.

Referring now to FIG. 9, the linkage 66 includes a horizontal bar 68 of generally square cross-sectional shape bent to form an upwardly projecting portion 70 to which is mounted a handle 72. The handle 72 extends at the side of the body-supporting portion 22 such as to be accessible to the occupant of the chair 20. Note that the handle 72 may extend at either one of the two sides of the body-supporting portion 22. The horizontal bar 68 is pivotally mounted in the plates 58, 56 and 54 in bushings 74, 76 (shown in FIG. 10) and 78. In particular, the horizontal bar 68 is received in the central aperture of each bushing 74, 76 and 78 whose internal diameter is about the same as the diagonal length of the square cross-section of the horizontal bar 68. Each bushing 74, 76 and 78 has a generally circular outer shape received in a mating aperture in the respective plate 54, 56 and 58. To prevent the bushing 74, 76 and 78 from turning in the respective plate 54, 56 and 58, each bushing 74, 76 and 78 is provided with a projection 80 received in a corresponding recess of the respective plate 54, 56 and 58.

The jaw 62, that is in the form of a plate including a curved gripping face 82 is mounted to the horizontal bar 68 such as to pivot with it when the handle 72 is moved by the occupant of the chair 20. To accomplish this result, the jaw 62 is provided with a square aperture matching in size the cross-sectional shape of the horizontal bar 68. The square aperture locks the jaw 62 on the horizontal bar 68 and prevents any relative angular movement of the jaw 62 with relation to the horizontal bar 68.

The jaw 64 is also in the form of a flat plate with a gripping face 84 having about the same curvature as the curvature of the gripping face 82. The jaw 64 is pivotally mounted to the plate 56 at the pivot point 86. Motion is communicated from the jaw 62 to the jaw 64 by a short link 88 pivoted at 90 at the jaw 62 and at 92 at the jaw 64.

Figure 2:
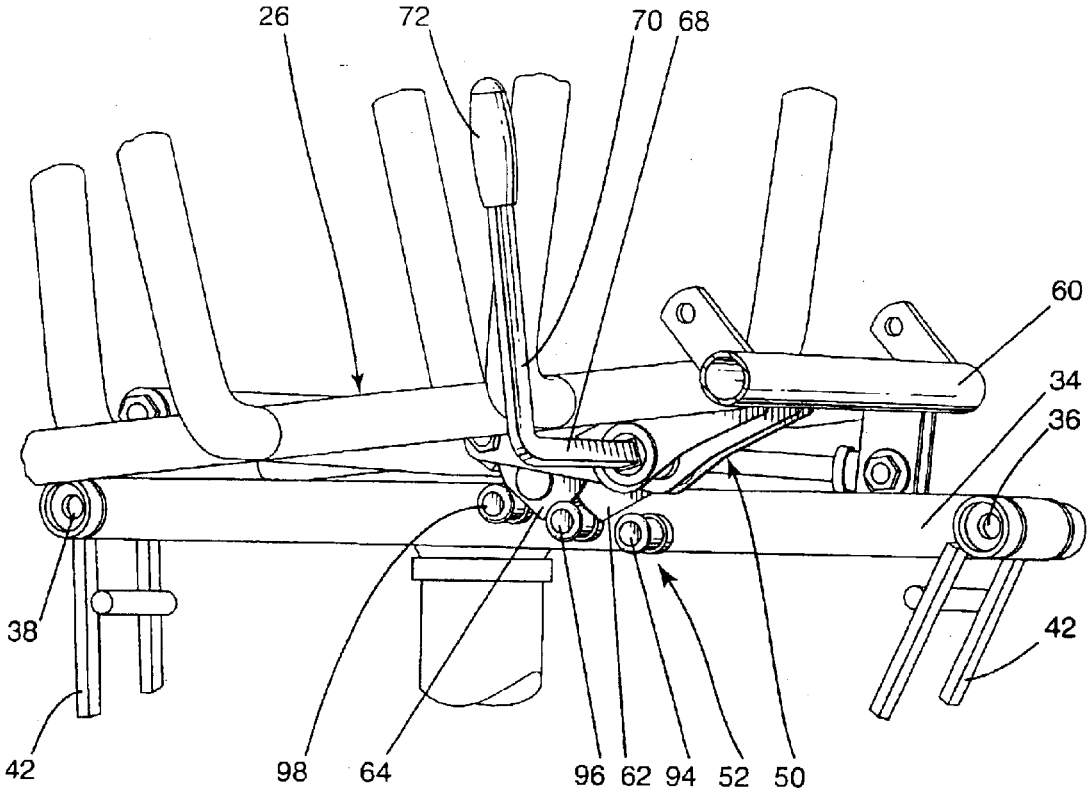
FIG. 2 is an enlarged perspective view of the locking assembly shown in FIG. 1.

Referring to FIG. 2, the second locking assembly component 52 includes a plurality of pins 94, 96 and 98 that are disposed along an arc of circle that follows the path of travel of the first locking assembly component 50 when the chair 20 is rocking. Each pin 94, 96 and 98 corresponds to a different locking position of the locking assembly 26.

Figure 5:
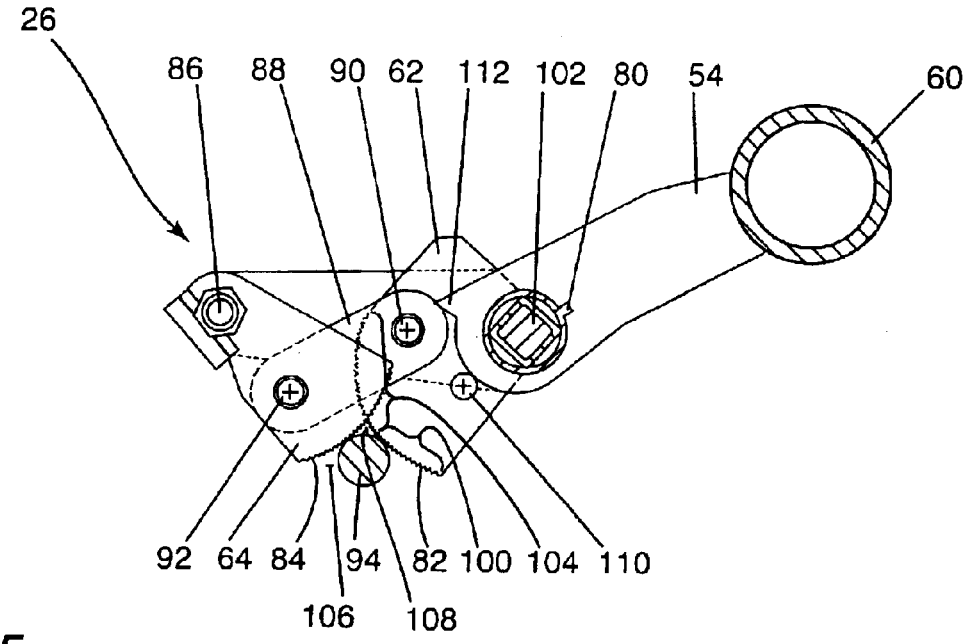
FIG. 5 is a schematical view of the locking assembly, depicting the relative position of the jaws of the first assembly component, showing the jaws in a position to grip a pin of the second locking assembly component.
Figure 6:
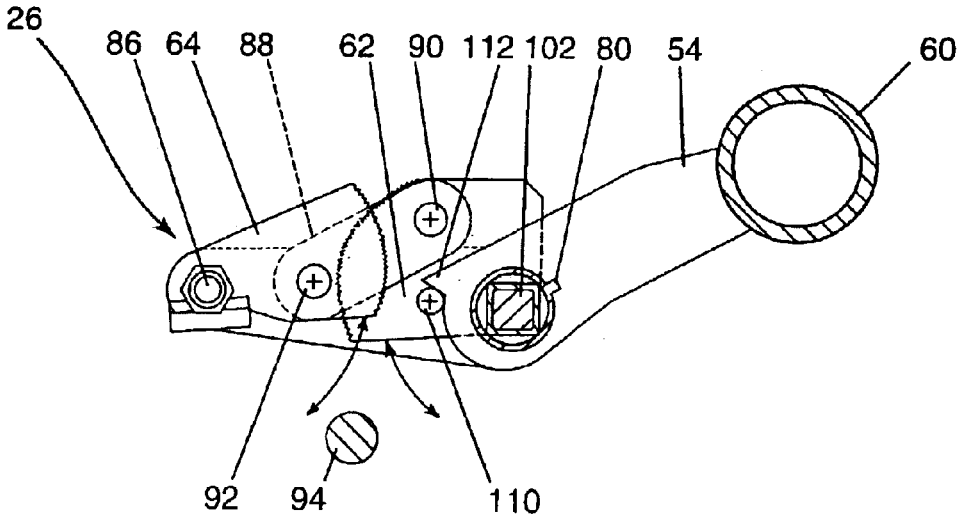
FIG. 6 is a view similar to FIG. 5, showing the jaws in a position to allow the chair to rock.
Figure 7:
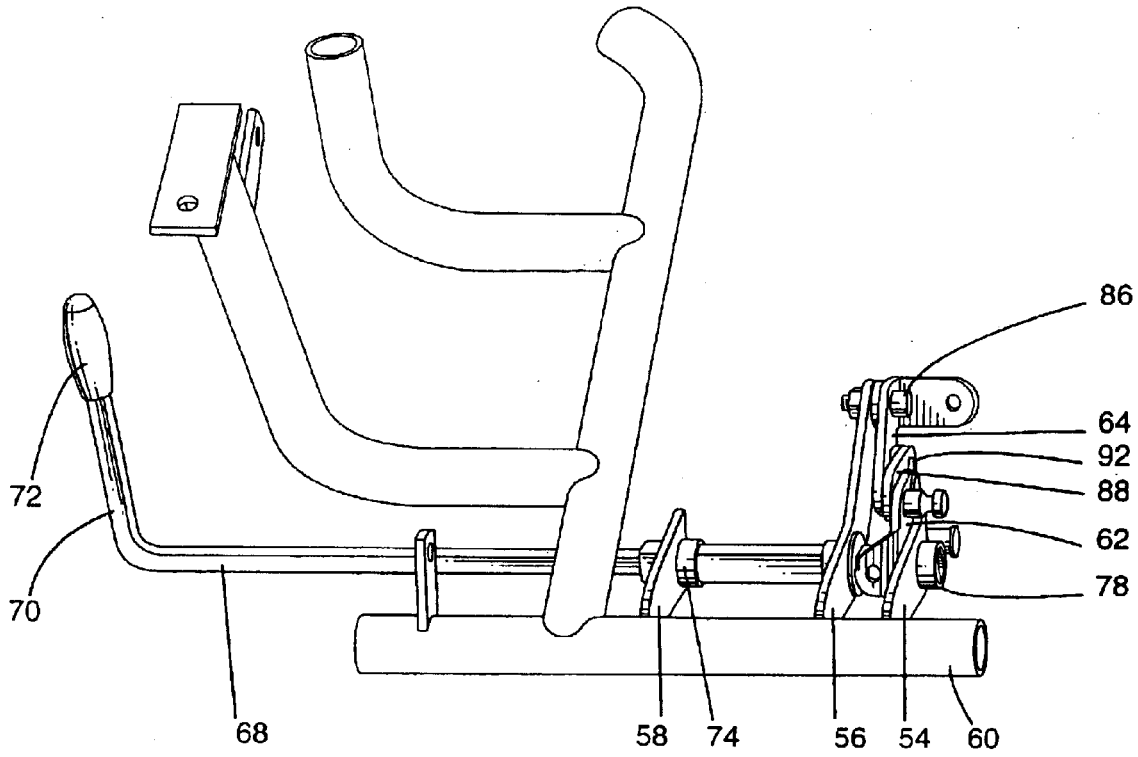
FIG. 7 is a perspective view from the top of the locking assembly in accordance with the invention, some components of the chair being also illustrated to provide a frame of reference.
Figure 8:
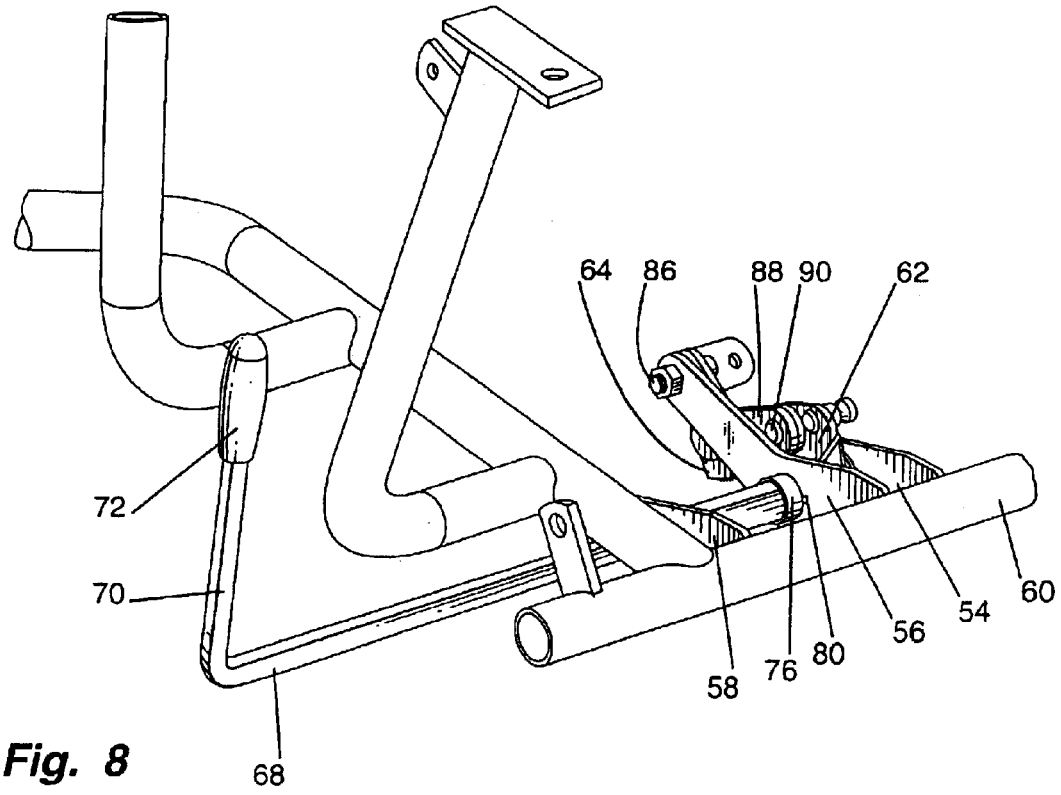
FIG. 8 is yet another perspective view from the top of the locking assembly in accordance with the invention, some components of the chair being also illustrated to provide a frame of reference.

The operation of the locking assembly 26 is shown in greater detail in FIGS. 5 and 6. In FIG. 6, the locking mechanism 26 is in the un-locked position. In this position, the jaws 64 and 62 are retracted upwardly such as to clear the pins 94, 96 and 98. This allows the chair 20 to rock since there is no interference between the first locking assembly component 50 and the second locking assembly component 52.

FIG. 5 illustrates the position of the jaws 64 and 62 when the locking assembly is locked. The locking position is accomplished by causing the horizontal bar 68 to pivot by operating the handle 72. The pivotal movement of the horizontal bar 68 causes a turning motion of the jaw 62 in one direction. A similar motion but in the opposite direction is also imparted to the jaw 64 by the intermediary of the link 88. The geometrical shape of the jaws 62 and 64, in particular the shape of the curved gripping faces 82 and 84 are selected such as when the handle 72 is operated to lock the chair 20, the gripping faces 82, 84 move down and at the same time open sideways to wedge between them a pin (pin 94 shown in this example). It will be noted from FIG. 5, that the gripping face 82 has a lower portion 100 that is at a shorter distance from the pivot point 102 of the plate 54 (the point at which the plate 54 is mounted to the horizontal bar 68) than the distance between the pivot point 102 and the upper portion 104 of the gripping face 82. When each portion 100, 104 is shaped as an arc of circle it means that the radius of the arc of the portion 100 is less than the radius of the arc of the portion 104.

This configuration allows the gripping faces 82, 84 during the initial phase of the locking movement to move faster laterally (open-up) than downwards. Accordingly, the jaws 64, 62 during the initial phase of the locking movement spread laterally rapidly such as to form a receptacle 106 between their gripping faces 82, 84 and <<catch>> a pin 94, 96 or 98. Note that the lateral movement is effected with respect to a plane of reference that is normal to the axis of the pin 94 and also parallel to the jaws 62, 64. Subsequently, the jaws 64, 62 move down more rapidly such as to cause the pin to enter the receptacle 106 and become wedged in a pin-retention area 108 of the receptacle where the pin is engaged by both gripping faces 82, 84. If during the downward movement of the jaws 62, 64 the pin 94 is not exactly centered between the two gripping faces 82, 84, the pin 94 will initially bear on one of the gripping faces 82, 84. The tapering gripping faces 82, 84 will guide the pin toward the pin-retention area 108.

The locking assembly 26 is disengaged by rotating the horizontal bar 68 in the other direction. This causes the jaws 62, 64 to pivot in the opposite directions such as to displace the gripping faces 82, 84 first up and then laterally toward one another until the position in FIG. 6 has been reached. In this position, the pin is released from the jaws 62, 64 and the body-supporting portion 22 of the chair 20 is free to rock with respect to the chair base portion 24. To prevent the locking assembly 26 from moving beyond the position shown at FIG. 6, a stop is provided. The stop includes a pin 110 that projects from the jaw 64 and that engages a tooth 112 extending from the plate 54.

Figure 12:
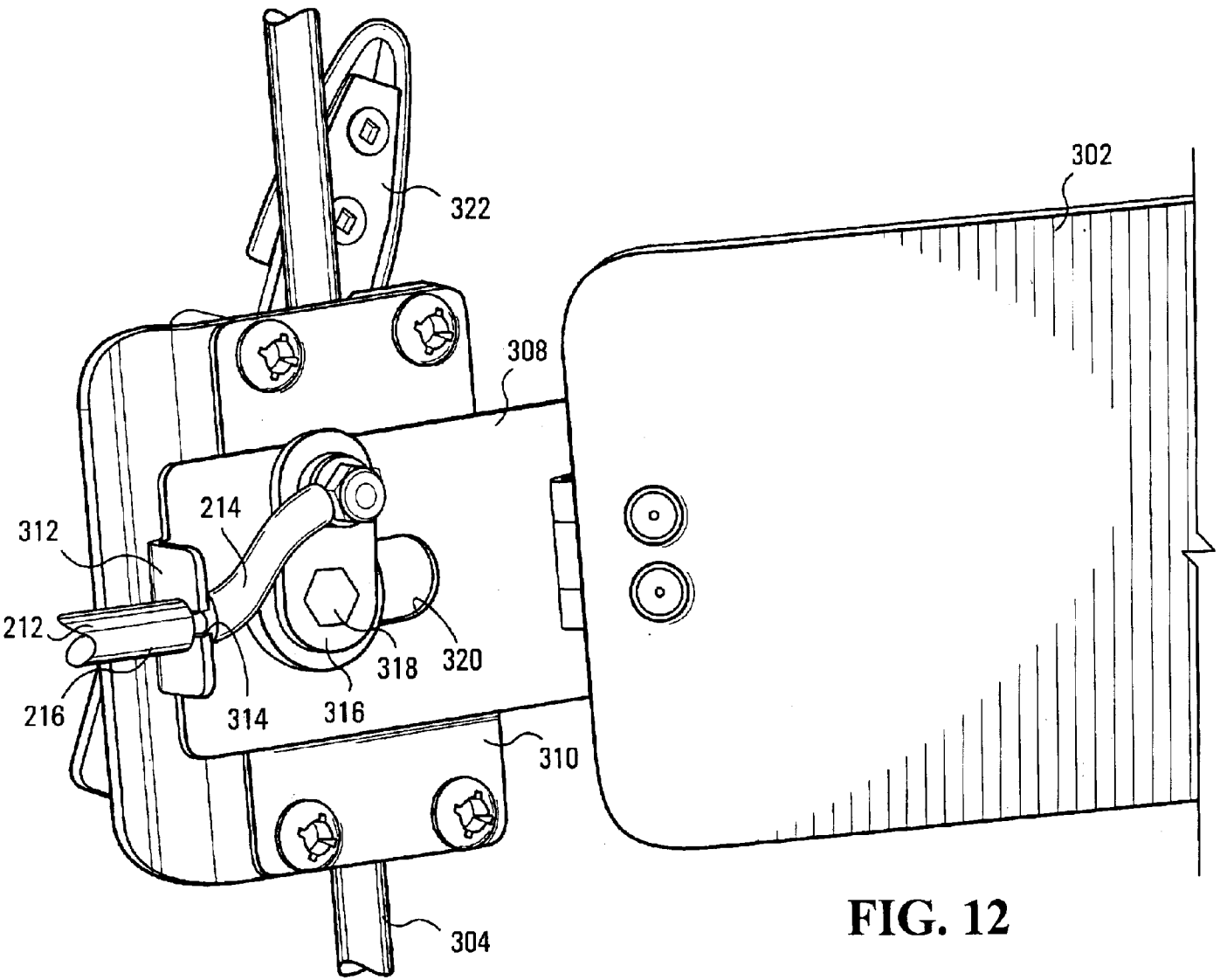
FIG. 12 is an enlarged front perspective view of the linkage shown in FIG. 11, illustrating details of the mechanism.
Figure 13:
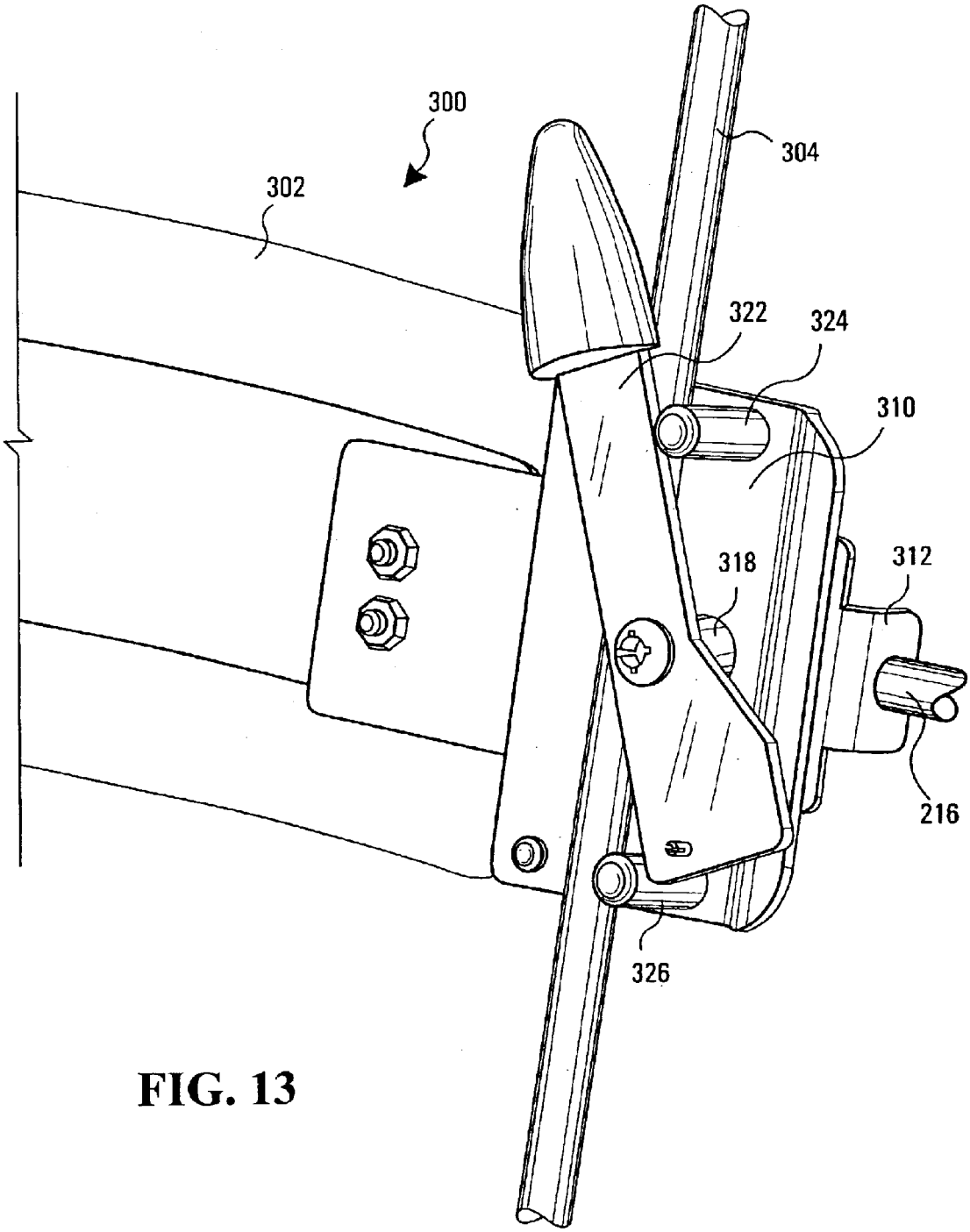
FIG. 13 is an enlarged rear perspective view of the linkage shown at FIG. 11.
Figure 14:
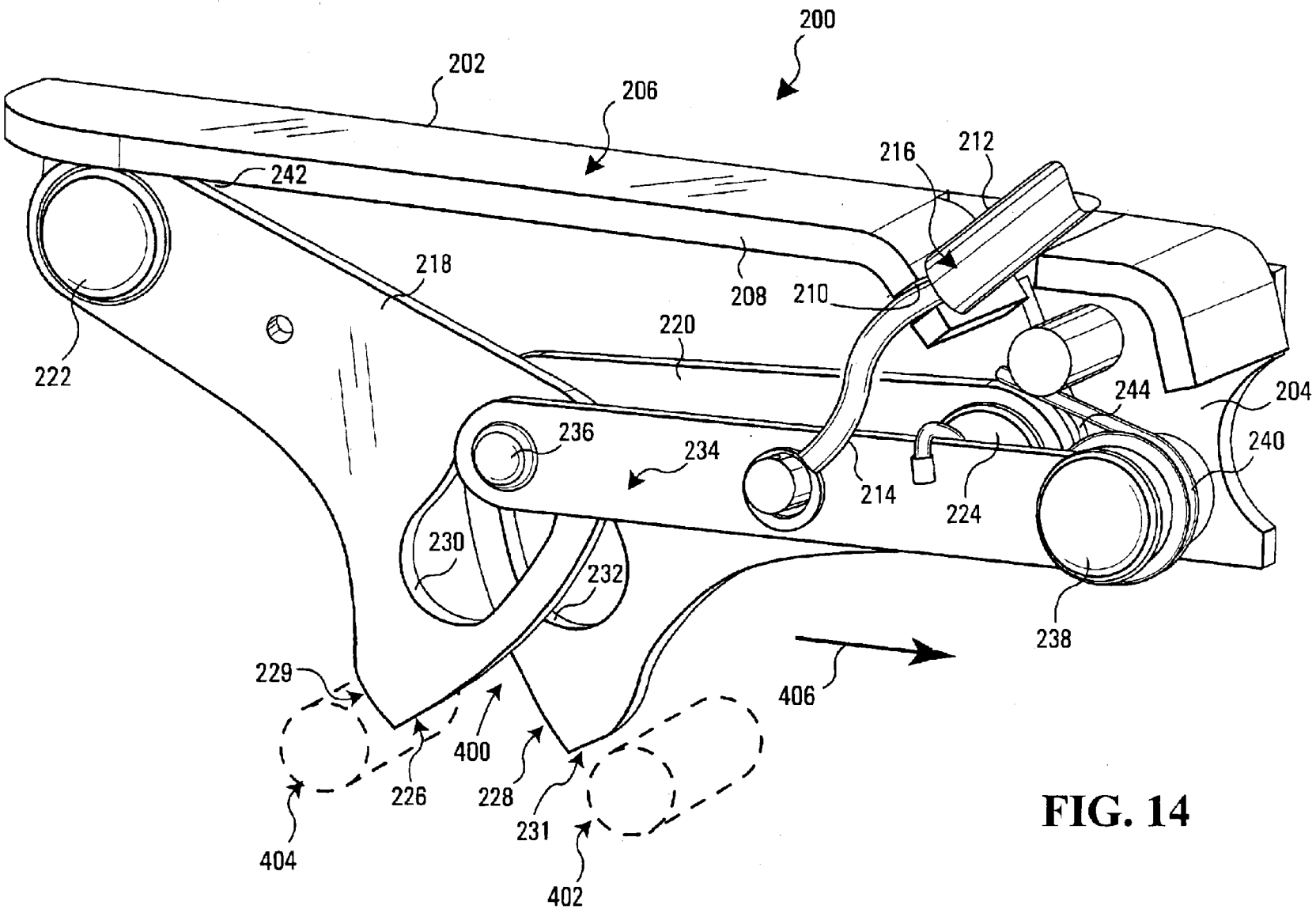
FIG. 14 is a perspective view of the first locking assembly component of the locking assembly, according to a variant, well suited for use with the linkage illustrated in FIGS. 11 to 14.

FIGS. 11 to 14 illustrate a variant. FIG. 14 is a perspective view of the first locking assembly component 200 that is suitable for use with a cable-operated linkage that will be described later. The first locking assembly component 200 works in conjunction with a second locking assembly component, not shown in FIG. 14, that is identical to the second locking assembly component 52 described earlier, including a plurality of pins defining different locking positions. As mentioned earlier, the first and second locking assembly components can be mounted to the body-supporting portion of the chair and to the chair base, respectively. The reversal is also possible, where the first locking assembly component is mounted to the chair base while the second locking assembly component is mounted to the body-supporting portion of the chair.

The first locking assembly component 200 includes a support member 202 in the form of a metallic plate that has a vertical part 204 and a horizontal part 206. The horizontal part 206 includes downwardly bent lip 208 with a slot 210 therein for receiving a cable 212 that operates the locking assembly, the cable 212 thus forming part of the linkage in this variant example of implementation. The cable 212 has a core member 214 that moves in a sheath 216. The size of the slot 210 is sufficient to accommodate the core 214 such that it can move therein, while blocking the sheath 216.

The first locking assembly component 200 further includes a pair of jaws 218 and 220 pivotally mounted at pivot points 222 and 224, respectively, on the vertical part 204. The jaws 218 and 220 have respective gripping faces 226, 228, generally opposite to one another. In addition, the jaws have camming faces 229, 231.

The jaws 218 and 220 have arcuate slots 230 and 232. The slots 230 and 232 are formed in such a way that they overlap one another, at least partially. Under this variant, another component of the linkage is an actuator bar 234 having a pin 236 received in the slots 230 and 232. The actuator bar 234 is pivoted at 238. The pivot point 238 defines a pivot axis that is generally parallel to the pivot axis of pivot points 222 and 224. The core 214 of the cable 212 is fastened to the actuator bar 234 at a point intermediate the pin 236 and the pivot point 238. Thus, by pulling the cable core 214, the actuator bar is caused to turn clockwise imparting, in turn, a pivotal movement to both jaws 218, 220 through the interaction between the pin 236 and the slots 230, 232.

The actuator bar 234 is urged to pivot counterclockwise to a lower limit position, by a coil spring 240. The lower limit position is a position where the arcuate slots 230, 232 will no longer allow the pin 236 to move. More specifically, as the actuator bar 234 pivots in a counterclockwise direction, the pin 236 travels downwardly. The pin 236 rides in the arcuate slots 230 and 232 which also move since the jaws 218, 220 travel downwardly under the effect of gravity. During this downward travel the jaws 218, 220 part their gripping faces 226, 228. The geometry of the slots 230, 232 and of the actuator bar 234 is such that as the jaws 218, 220 move downwardly, the pin 236 becomes wedged in the slots 230, 232. The pin 236 can no longer move down anymore and this constitutes the lower limit position.

In order to ensure that both jaws 218, 220 will move downwardly when the actuator bar 234 pivots counterclockwise, coil springs 242, 244 are provided on the pivot points 222, 224, respectively to urge the jaws 218, 220 downwardly.

Figure 11:
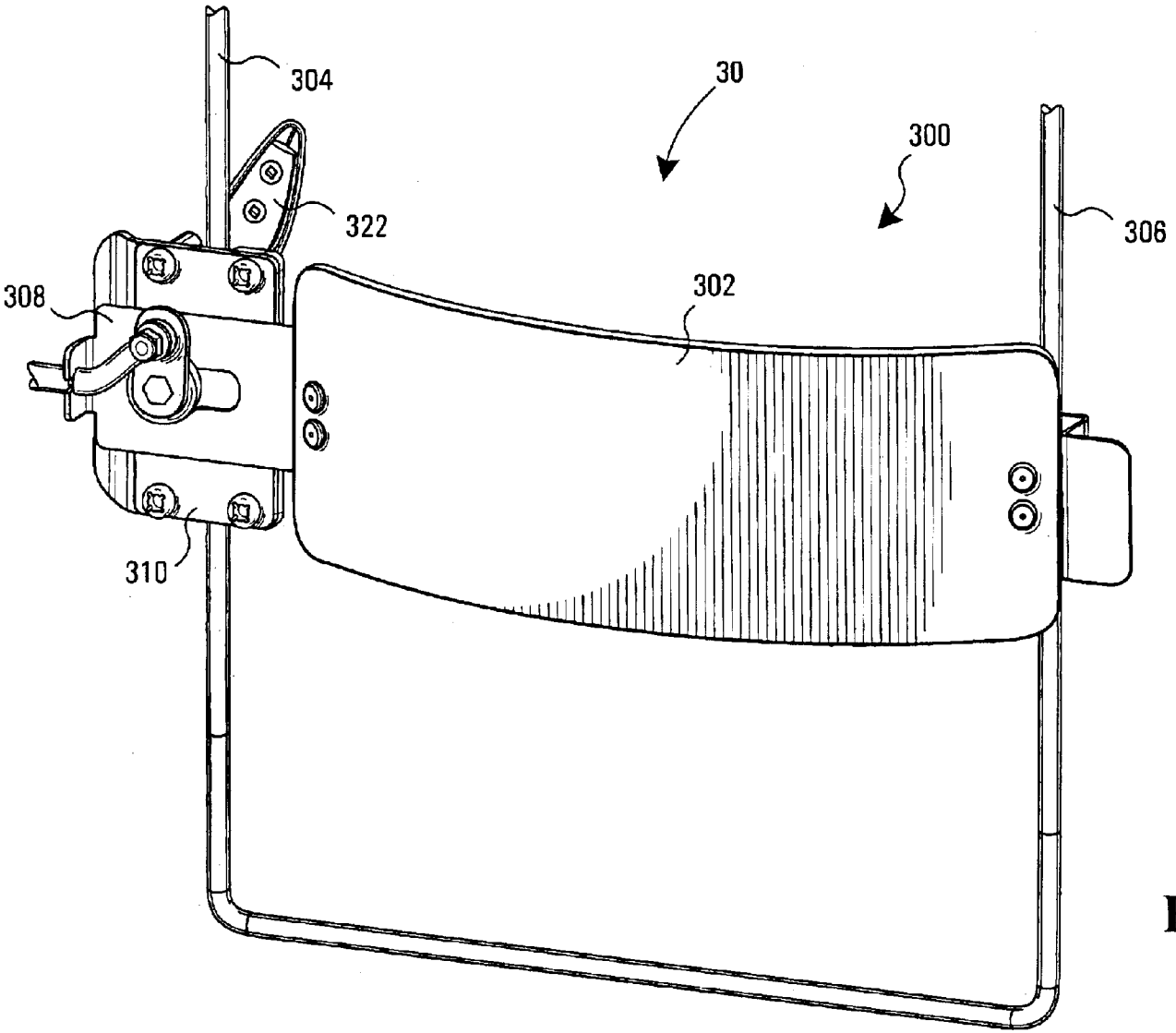
FIG. 11 is a perspective view of the backrest of a rocking chair, illustrating a linkage responsive to pressure applied by the occupant of the chair to operate the locking assembly.

The linkage that operates the first locking assembly component 200 will now be described in connection with FIGS. 11, 12 and 13. The linkage component 300 is mounted on the backrest 30 of the chair and is responsive to pressure applied by an occupant seated in the chair. More specifically, the linkage component 300 is designed to actuate the locking assembly such as to prevent the chair from rocking when no pressure is applied to the linkage component 300. Thus, when no one is sitting in the chair, the locking assembly precludes any rocking movement.

The linkage component 300 includes a forwardly bowed strip 302 that extends across the two vertical posts 304, 306 of the backrest 30. The bowed strip 302 is permanently attached to the post 306. In contrast, the bowed strip 302 is mounted at the other end to a plate 308, which can slidingly move on a bed 310, attached to the post 304. The bowed strip 302 is normally under the upholstery of the chair. The bowed strip 302 is made of material that is sufficiently resilient such that when no pressure is exerted on the backrest 30 of the chair, the strip 302 is in the bowed configuration, as shown at FIG. 11. On the other hand, when an occupant sits in the chair and applies pressure on the backrest 30, the strip 302 will distort to the rear, causing the plate 308 to slide relative to the bed 310.

The bowed strip 302 can be made of plastic material having the necessary resiliency characteristics.

As shown in FIG. 12, the plate 308 is mounted at one end to the bowed strip 302. At the other end, the plate 308 has a lip 312 to which is mounted the cable 212. The cable section between the linkage component 300 and the locking assembly is not shown in the drawings for simplicity. The cable 212 can be routed as required between the two components. The lip 312 is provided with a slot 314 to slidingly receive the cable core 214 while blocking the cable sheath 216. The cable core 214 is mounted to the end of an arm 316 keyed to a pin 318. The pin 318 is received in a slot 320 whose length defines the range of movement of the plate 308 with relation to the bed 310.

With reference to FIG. 13, the pin 318 projects from the back of the bed 310 and supports a lever 322. Turning the lever 322 between abutments 324 and 326 causes the pin 318 and the arm 316 to undergo the same amount of angular displacement.

To summarize, when an occupant is sitting in the chair and leaning back against the backrest 30, the bowed strip 302 is distorted backwardly which has the effect of straightening the strip 302. Since the end of the strip 302 is fixed at the post 306, the other end of the strip 302, which carries the plate 308, will move laterally outwardly with relation to the bed 310. Since the core 214 of the cable 212 is fixed, this sliding movement will cause the sheath 216 to move over the core 214, thus unlocking the locking assembly. More specifically, the movement of the cable sheath 216 causes the cable core 214, at the level of the first locking assembly component 200 to be pulled, thus raising the actuator bar 234 and the jaws 218 and 220, against the resiliency of the springs 240, 242 and 244.

When the pressure acting on the bowed strip 302 ceases, the reverse happens. The cable sheath 216 retracts on the core 214, thus the pulling force applied on the actuator bar 234 by the cable core 214 stops. As a result, the actuator bar 234 and the jaws 218 and 220 descend to engage the second locking assembly component.

The role of the lever 322 is to disable the operation of the locking assembly. When the lever 322 is turned counterclockwise (as viewed in FIG. 13) up to the abutment 326, it causes the pin 318 to pivot about a quarter of a turn, which brings the arm 316 generally horizontal. This pulls the cable core 214 and has the same general effect on the system as when a person sits on the chair and applies pressure on the backrest 30. The locking assembly is deactivated and the chair can rock irrespective of whether pressure is applied on the backrest or not. To restore the functionality of the locking assembly 200, the lever is turned back to a position where it engages the abutment 324.

Referring back to FIG. 14, the operation of the first locking assembly component will be discussed in greater detail. As with the previous embodiment, the jaws 218 and 220 form between them a receptacle 400 to catch any one of the pins of the second locking assembly component. For clarity, the second locking assembly component is not shown in FIG. 14, its structure and operation being identical to the second locking assembly component 52.

In the event that the first locking assembly component 200 operates but not one of the pins of the second locking assembly component precisely registers with the receptacle 400, the camming faces 229 and 231 will cause the jaws 218, 220 to yield upwardly when engaging any one of the pins. Assume for the purpose of the present discussion that the jaws 218 and 220 are located precisely between two pins of the second locking assembly component. The pins shown in dotted lines are identified by the references 402 and 404. In this position, it will be evident that the jaws 218, 220 cannot engage any one of the pins 402, 404 since the camming surfaces 229 and 231 rest on the pins 402 and 404. However, the ramps of the respective camming surfaces 229 and 231 are such that when the body-supporting portion 22 moves, the jaws 218, 220 will be raised upwardly, against the resiliency of the coil springs 242, 244. This movement is also allowed by virtue of the arcuate slots 230, 232 in which the pin 236 can move. Say that the movement of the body-supporting portion 22 occurs in the direction of the arrow 406. The jaw 220 will be raised until the jaw 220 has cleared the pin 402, at which point the jaw 220 will descend and the pin 402 will be captured in the receptacle 400. The same sequence of events will happen with the jaw 218 if the body-supporting portion 22 moves in the opposite direction.

The above described feature operates as a ratchet, allowing the body-supporting portion 22 to move until any one of the pins of the second locking assembly component is firmly engaged in the receptacle 400.

It is intended that the present application covers the modifications and variations of this invention provided that they come within the scope of the appended claims and their equivalents.

I claim:

1. A chair, comprising:

a. a body-supporting portion, including:
   i. a seat;
   ii. a backrest;

b. a chair base portion, said body supporting portion capable to move with respect to said chair base portion;

c. a locking assembly, including:
   i. a first locking assembly component mounted to one of said body-supporting portion and said chair base portion;
   ii. a second locking assembly component mounted to the other of said body-supporting portion and said chair base portion;

d. a linkage including a strip of resilient material mounted to said backrest, said strip of resilient material extending across said backrest such that said strip is positioned to receive at least a portion of the back of an occupant of said chair, said strip of resilient material having a resiliency such that:
   i. when the occupant applies pressure on said backrest, said strip is deformed rearwardly from an original position;
   ii. when the pressure applied by the occupant ceases, said strip returns to said original position;

e. said linkage operatively connected to said locking assembly to cause:
   i. engagement of said first and second locking assembly components for preventing movement of said body supporting portion relative to said chair base portion when said strip is in said original position;
   ii. release of the engagement of said first and second locking assembly components when said strip is deformed rearwardly from said original position.

2. A chair as defined in claim 1, wherein said second locking assembly component includes a pin.

3. A chair as defined in claim 2, wherein said first locking assembly component includes a pair of jaws, at least one of said jaws being responsive to the return of said strip to said original position to undergo displacement with relation to the other jaw such as to cause engagement of said pin between said jaws, at least one of said jaws being responsive to the rearwardly deformation of said strip to cause release of said pin from between said jaws.

4. A chair as defined in claim 3, wherein said second locking assembly component includes a plurality of pins selectively engageable by said jaws to interlock said first locking assembly component with said second locking assembly component.

5. A chair as defined in claim 4, wherein said jaws are responsive to the return of said strip to said original position such that each jaw undergoes displacement with relation to the other jaw to define a receptacle between said jaws for engaging said pin.

6. A chair as defined in claim 5, wherein said jaws include gripping faces that define between them said receptacle, said gripping faces tapering toward one another to form a pin-retention area where said pin is engaged by the gripping face of each jaw.

7. A chair as defined in claim 6, wherein said jaws are responsive to the return of said strip to said original position such that each jaw undergoes displacement with relation to the other jaw to define a receptacle between said jaws for engaging said pin and for moving said pin such as to cause said pin to enter said receptacle.

8. A chair as defined in claim 7, wherein said jaws are responsive to the return of said strip to said original position such that each jaw undergoes displacement with relation to the other jaw to define a receptacle between said jaws for engaging said pin and for moving said receptacle toward said pin such as to cause said pin to enter said pin-retention area of said receptacle.

9. A chair as defined in claim 8, wherein said jaws pivot in response to said the return of said strip to said original position.

10. A chair as defined in claim 9, wherein in response to the return of said strip to said original position, one of said jaws pivot clockwise and the other of said jaws pivots counter-clockwise.

11. A chair us defined in claim 10, wherein said first locking assembly component further includes an actuator bar rotatable about a pivot axis, both of said jaws being mounted to said actuator bar to pivot therewith when said bar is rotated about said pivot axis.

12. A chair as defined in claim 11, wherein said jaws include arcuate slots, said actuator bar including a pin received in said arcuate slots whereby rotation of said actuator bar about said pivot axis imparts a pivotal movement to said jaws.

13. A chair as defined in claim 12, wherein during the return of said strip to said original position, said actuator bar rotates in a first direction to a lower limit position in which said pin of said actuator bar is wedged in the arcuate slots of said jaws.

14. A chair as defined in claim 13, wherein rotation of said actuator bar in said first direction causes said jaws to move with relation to each other for defining said receptacle, in said lower limit position said receptacle receiving said pin in said pin-retention area of said receptacle.

15. A chair as defined in claim 14, wherein during the rearwardly deformation of said strip from said original position, said actuator bar rotates in a second direction opposite said first direction, rotation of said actuator bar in said second direction causing said jaws to move with relation to each other for releasing said pin from said receptacle.

16. A chair as defined in claim 15, wherein said linkage further includes a cable section connecting said strip to said actuator bar, said cable section operative to impart movement of said strip to said actuator bar.

17. A chair as defined in claim 16, wherein one end of said cable section is fixedly attached to said actuator bar, the other end of said cable section being coupled to said strip whereby the rearwardly deformation of said strip from said original position causes said cable section to apply a pulling force on said actuator bar for rotating said actuator bar in said second direction, causing said jaws to move toward each other and away from said pin.

18. A chair as defined in claim 17, wherein the return of said strip to said original position causes said cable section to cease the application of said pulling force on said actuator bar such that said actuator bar rotates in said first direction, causing said jaws to move away from each other and toward said pin such that said pin is received in said pin-retention area of said receptacle.

19. A chair as defined in claim 1, wherein, when said strip of resilient material is in said original position, said strip is forwardly bowed relative to said backrest.

20. A chair as defined in claim 19, wherein said strip of resilient material has first and second ends, said first end being fixedly attached to said backrest, said second end being slideably mounted to said backrest such that, when said strip is deformed rearwardly, said second end slides laterally outwardly relative to said backrest.

21. A chair as defined in claim 20, wherein said linkage further includes a cable section connecting said strip of resilient material to said locking assembly, said cable section operative to impart movement of said strip to said locking assembly.

22. A chair as defined in claim 21, wherein one end of said cable section is fixedly attached to said first locking assembly component, the other end of said cable section being coupled to said second end of said strip such that, when said second end slides laterally outwardly relative to said backrest, said cable section is responsive to the sliding movement of said second end to cause the release of the engagement of said first and second locking assembly components.

* * * * *